US008057078B1

(12) United States Patent
Ko

(10) Patent No.: US 8,057,078 B1
(45) Date of Patent: Nov. 15, 2011

(54) LATERAL AND DIRECTIONAL POLETOP ILLUMINATOR

(76) Inventor: Gordon Ko, Phillips Ranch, CA (US)

( * ) Notice: Subject to any disclaimer, the term of this patent is extended or adjusted under 35 U.S.C. 154(b) by 67 days.

(21) Appl. No.: 12/767,440

(22) Filed: Apr. 26, 2010

(51) Int. Cl.
*F21S 8/00* (2006.01)
*F21S 13/00* (2006.01)

(52) U.S. Cl. ..... 362/431; 362/234; 362/253; 362/812; 116/173; 116/174

(58) Field of Classification Search ..... 362/234, 362/253, 431, 812; 116/173, 174
See application file for complete search history.

(56) References Cited

U.S. PATENT DOCUMENTS 1,256,232 A * 2/1918 Howard ..... 116/173
3,752,975 A 8/1973 Meyer
5,988,100 A 11/1999 Schmitt
6,263,601 B1 7/2001 Emert
6,951,408 B2 10/2005 Stewart
6,955,456 B2 * 10/2005 Schroeder ..... 362/431
7,082,889 B2 8/2006 Clark
7,275,495 B2 10/2007 Lawrence et al.
D562,487 S 2/2008 Romo
7,517,106 B1 4/2009 Wang
7,699,508 B2 * 4/2010 Schroeder ..... 362/431

* cited by examiner

*Primary Examiner* — Stephen F Husar

(57) ABSTRACT

The present invention relates to an environmentally friendly beacon or light for illuminating a pole-mounted flag, banner, pennant or the like that has a luminous source located in a laterally extending cover, is mounted on top of the pole, and is capable of continuously directing an umbrella shaped illumination toward the flag, banner, pennant or the like as the wind blows the same to rotate about the flagpole. The flagpole light of the present invention is designed to be installed as a retrofit in existing flagpoles having a shaft supported knob or sphere located a short distance above a rotatable cap.

14 Claims, 5 Drawing Sheets

LATERAL AND DIRECTIONAL POLETOP ILLUMINATOR

FIELD OF THE INVENTION

The present invention relates generally to a self-actuating, self-powered light for directionally illuminating a pole-mounted flag, banner, pennant or the like. In particular, the present invention relates to such a light that has a luminous source located in a laterally extended cover mounted on top of the pole, and is capable of continuously directing a fully encompassing beam of light toward the flag, banner, pennant or the like as wind causes the flag to be changed in radial direction about the pole.

BACKGROUND OF THE INVENTION

Pole-mounted flags deserving of presentation are typically those representing a nation, company, university, or other prestigious organization and intended to, by the elevation, care and clear visualization of such flags, instill a sense of respect and awe for the organization whose memory is recalled. There is no better time for effective visualization of such a flag than at night. All prior art for presentation of flags at night is directed at the same basic requisite function—to illuminate the flag while minimizing lighting equipment and utility costs. The advantage and disadvantage of a ground mounted, high-powered spotlight has been obvious since the 1800's. Regardless of its ground level distance from the flag pole, a single beam of light directed at a flag from ground level generally loses the dramatic of such lighting through about three fourths of a flag's potential radial extension from the pole as wind direction causes the flag to be blown in several different directions. It is well known to place a ground level directional light in the direction of the prevailing wind so that a flag will be illuminated much of the time. An obvious solution is to increase the number of ground level directional lights to ring the flagpole, with subsequent increase in equipment and utility costs. Ground level equipment is a barrier to traffic about the flag pole but it convenient for maintenance.

Not so for sources of illumination raised to the top of a flagpole. Maintenance must essentially be eliminated for a source of light raised to a top of a flagpole to illuminate a flag flying just below and adjacent to that source of light. That requirement alone eliminates from consideration of practical use many proposed devices in the prior art which are intended to illuminate a direction-changing, wind blown flag. A structure at the top of a flagpole experiences the most severe of local weather conditions in terms of extremes of temperature and precipitation, as well as receiving the occasional well-fed avian visitor and its excremental deposits. The requirements of a flag-top illumination device must be minimal to avoid taking the entire pole down or to bring to the flag pole a personnel lift of extreme lifting height to conduct repairs or replacement of equipment. At the minimum, any illumination source for a pole-top light must have an exceptionally long life and operate substantially to accomplish its illumination job in at least partial failure mode so maintenance can be delayed until regularly planned events.

A further challenge in providing illumination of a wind blown flag is to provide directionally efficient lighting. A simple pole-top light wired to a ground level source of electricity and having a transparent or translucent globe draws attention more to the light than to the illuminated flag. Its axial location provides a point source illumination more to the sky than to the desired flag lighting. However, such a simple device provides illumination for the radial extension of the flag in its potentially 360 degree travel path.

A rather simple-minded but ineffective improvement to the light bulb on top of the flag pole is found in U.S. Pat. No. 7,275,495. The '495 patent discloses what is essentially a replacement of the light bulb which illuminates spherically with a flashlight aimed at an angle of about 45 degrees downward and outward (but mounted within) from a decorative sphere at the top of the flagpole. It is rotatable via its integration with the pulley wheels for flag-elevating and supporting rope or cable so that a rotation of the flag about the pole pulls at the supporting rope, which in turn pulls at the pulley, which in turn pulls at the flashlight to kind of direct it toward the new direction of the flag. The requisite broad downward angle of the light cause it to, like the simple pole top light, illuminate unnecessary space and often not the space in which the flag is to be found. A ground level viewer will be somewhat blinded by the light in favor of viewing the flag.

The '425 patent identifies a problem which its intended device does not solve. While such a device allows for the use of less light than a floodlight, it still does not solve the problem of illuminating more of the surrounding sky than the flag itself.

Therefore, a need exists for an improved pole top light which minimizes requirement for any maintenance, operates in substantial failure mode to effect illuminating a flag, and is exceptionally responsive directionally for nighttime illumination of the flag in whatever direction it is moved by the wind.

SUMMARY OF THE INVENTION

The present invention continuously directs an umbrella shaped beam of light substantially downward from a thin, aerodynamic, lateral-extension housing toward a flag, banner, pennant or the like as the wind blows the same in diverse radial directions about an axis of a supporting flagpole. The flag fixed to a top of a flagpole of the present invention is adapted to rotate freely into any radial direction from the flagpole axis in a manner well known in the art, whereby a top cap is provided with a bearing or axle about which the cap is free to rotate relative to the flagpole. The flag is fixed at the top of one vertical edge to this rotatable cap and at the lower end of said edge to an unfixed loop about the flagpole lower down. The rotatable cap is often provided with a sphere or statue of some type to enhance the aesthetics of the flagpole.

The prior art devices for rotatable cap flagpoles as just described are provided with a standard or typical clearance of about 1.5 to 2.5 inches between said decorative sphere and a topmost surface of said rotatable cap. Between the sphere and the rotatable cap is a supporting rod fixed at one end in the sphere and threaded at another end to be removably fixed in a threaded opening at the top of the rotatable cap. The present invention, in one form, is adapted to be mounted as a retrofit in a prior art rotatable cap flagpole within the 1.5 to 2.5 inches of the supporting rod exposed between the decorative sphere or other piece and a topmost end of the rotatable cap. Alternately, any vertical pole can be adapted to receive the invention light and associated flag or pennant.

The invention light is comprises a housing that is very thin vertically, narrow in its lateral extension from a flagpole axis and aerodynamically formed so that it presents very small resistance to wind, rain, sleet and snow, a critical feature of a light elevated to a top of a flagpole. The invention light has been tested for continuous flagpole lighting in the severe fall and winter conditions of Chicago and Minnesota with no failure or wear detected after such testing. In a preferred vertical thickness from a top surface of a housing to an underside of a transparent light cover, the invention light is from about 1.00 to 2.00 inches thick, and more preferably from 1.25 to 1.75 inches thick. The invention light is provided with a substantial solar panel integrated into the top surface of its housing, providing power for the LED's of the preferred lighting source.

The invention light further comprises weather proof protection for its rotation bearing. Said bearing is fixed at an inner race between a top rotation fitting and a lower rotation fitting so that the invention light may rotate upon contact of the housing with an outer race of the bearing or by rotation upon the inner race of the bearing, where the top rotation fitting, in combination with close coupling with said decorative sphere, provides a water tight seal from exposure of the underlying bearing and electrical components to water, sleet, or snow. Such protection has been found to extend the operational life of the rotation bearing and the electrical components of the invention light.

An object of the invention flagpole light is to provide a laterally extended pole top light which is highly directional in providing an umbrella shaped, downward illumination of a flag located just beneath said illumination by way of rotational connection with said flag of a rotatable cap flagpole.

A further object of the invention is provide a laterally extended pole top light having a minimized wind resistance profile.

Yet another object of the invention is to provide for a laterally extended pole top light having multiple power sources for recharging batteries with which to power lights via a solar panel and/or a small wind driven generator.

Another object of the invention is to provide a retrofit for a rotatable cap flagpole using an existing decorative sphere separated from a topmost part of the rotatable cap by a standard or typical vertical distance of about 1.5 to 2.5 inches.

Other objects, features, and advantages of the present invention will become apparent upon inspection of the following detailed description of the preferred embodiment of the invention, taken in conjunction with the drawings and appended claims.

DETAILED DESCRIPTION OF THE INVENTION

The invention is now discussed with reference to the figures.

Figure 1:
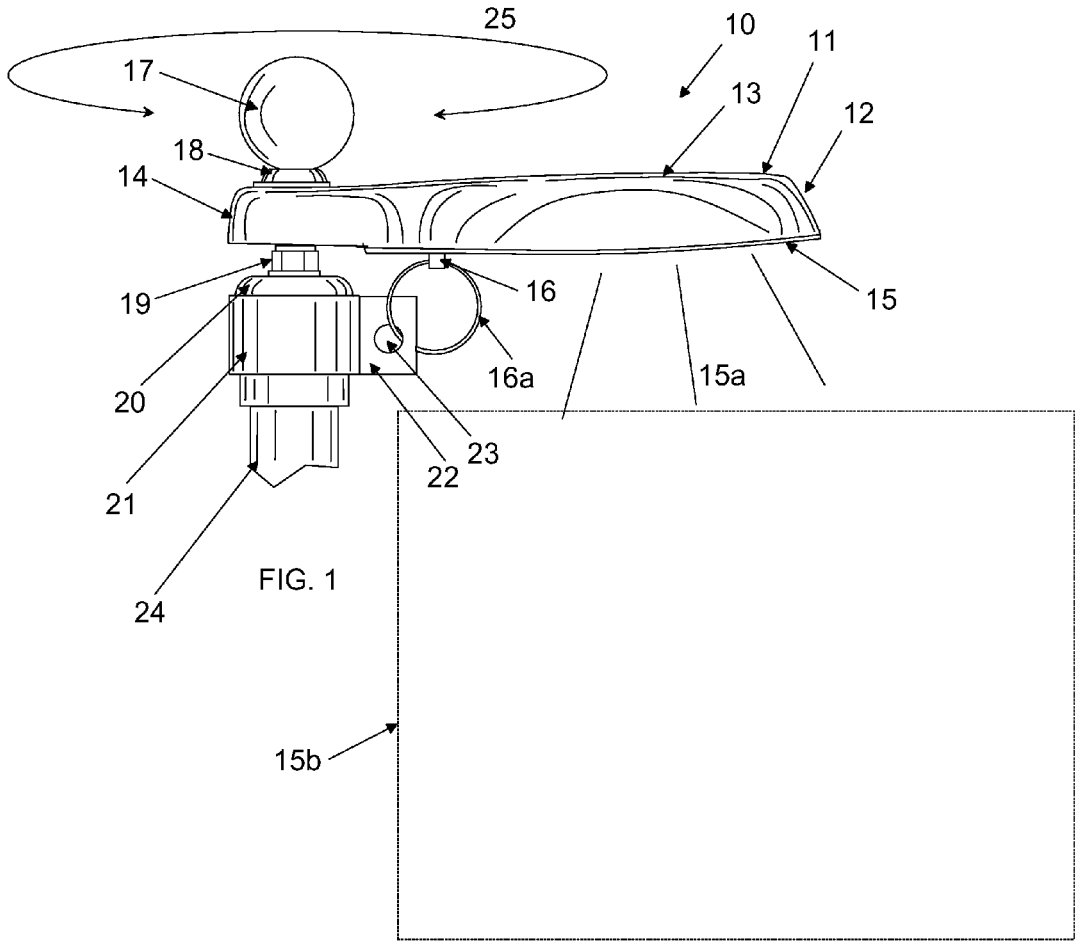
FIG. 1 is side view of one form of the invention pole top light for flagpoles.

The pole top light 10 for flagpoles shown in FIG. 1 comprises an aerodynamic housing 11 facing downward with an umbrella like illumination 15*a* projecting through a transparent cover 15 upon a flag illumination zone 15*b* shown in broken lines. Zone 15*b* is representative of a flag or pennant fixed at a top corner of a vertical edge at or near flange 22 by way of a closeable clip or carribeaner clip passing through opening 23 and a grommet at said corner and then also releasably and rotatably fixed at a lower corner of the same flag edge to the flagpole 24. Flange 22 laterally extends from rotatable band 21, which is supported from cylindrical band 24*a* and rotatably engages the top of flagpole 24. Metal loop 16*a* provides rotating inducing connection between flange 22 and rotation connector 16 extending downward from cover 15. When a flag in zone 15*b* is made to rotate to another of diverse radial angles from a flagpole axis than that shown in FIG. 1, housing 11 is drawn by its connection to flange 22 in path 25 so that it maintains its illumination 15*a* over a flag in zone 15*b* at all times.

Housing 11 comprises an axial end 14 arranged to be supported from an exposed portion of a support bolt extending downward from decorative sphere 17 through axial end 14, threaded through nut 19, and finally secured by threaded connection to pole top adapter 20, which is insertable into an open end flagpole 24, which supports rotatable band 21. Housing 11 also comprises a lateral extension end 12, an upper surface 13 of which bears a substantial solar panel which will absorb the sun's radiation and convert it to electrical power stored in batteries within housing 11. In the side view of FIG. 1, a vertical thickness of housing 11 and cover 15 is between 1.00 to 2.50 inches, and more preferably between 1.25 and 1.75 inches. Peripherally, housing 11 is substantially arcuately sloped from a lowest outer edge upward to upper surface 13 to achieve substantially unobstructed air flow from above or from any side of housing 11, forcing such air flow over an upper side of the solar panel and cleaning and scouring its surface of radiation blocking dirt or deposits. Locating said solar panel at an elevation typical of a flagpole and having such an arcuately sloped peripheral edge takes advantage of the stronger winds and precipitation to keep the invention pole top light functioning longer to absorb solar radiation at relatively full strength with a self-cleaning solar panel.

Figure 2:
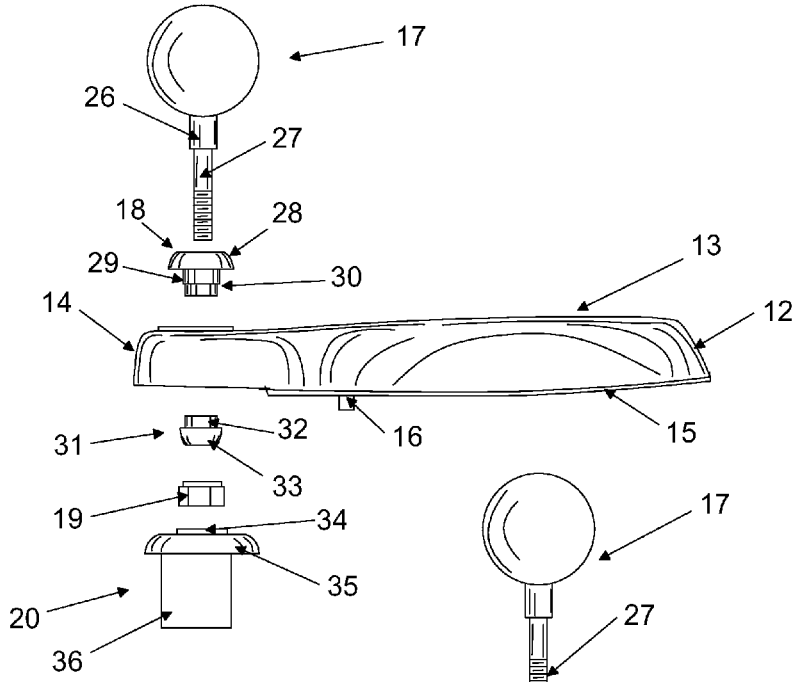
FIG. 2 is a side and exploded view of the pole top light for flagpoles shown in FIG. 1.
Figure 2:
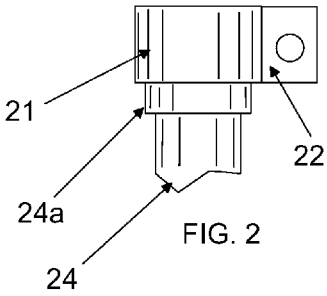

FIG. 2 shows additional detail of each normally separable part of the invention pole top light 10, where sphere 17 further comprises a bolt top 26 and a threaded bolt end 27 and a top rotation fitting 18 comprises an upper water tight seal 28 and first lower section 29 extending down from seal 28 with a cylindrical diameter greater than that of second lower section 30. A bottom rotation fitting 31 comprises a larger diameter section 33 from which extends upward a cylindrical section 32 of the same diameter as that of section 30 of top rotation fitting 18. A nut 19 is adapted to be threaded to the end of bolt end 27 after it passes sequentially through top rotation fitting 18, axial end 14 of housing 11, and bottom rotation fitting 31, whereafter nut 19 is threaded sufficiently upward on bolt end 27 so that top rotation fitting 18 and bottom rotation fitting 31 compress respectively top and bottom edges of an inner race of a bearing secured within axial end 14 with sufficient threaded length extending from a bottom side of nut 19 to be threaded into adapter 20 to support the entire assembly above it.

Adapter 20 comprises a top end 34 defining a threaded bolt hole, a flange skirt 35 extending out from top end 34 to support the entire assembly above it from rotatable band 21, and a cylindrical insert 36 extending down from skirt 35, which firmly engages inside cylindrical walls of a top end of flagpole 24. A rotatable cap in the present specific example comprising a simple cylindrical band 24*a* fixed at just below a top of flagpole 24 which supports the rotatable band 21 from which laterally extends flange 22. Rotatable band 21 rotates about flagpole 24 when wind causes a flag attached to flange 22 to be drawn in a different radial direction. Such firm engagement supports the entire superior assembly for long term use for the objects of the invention.

Figure 3:
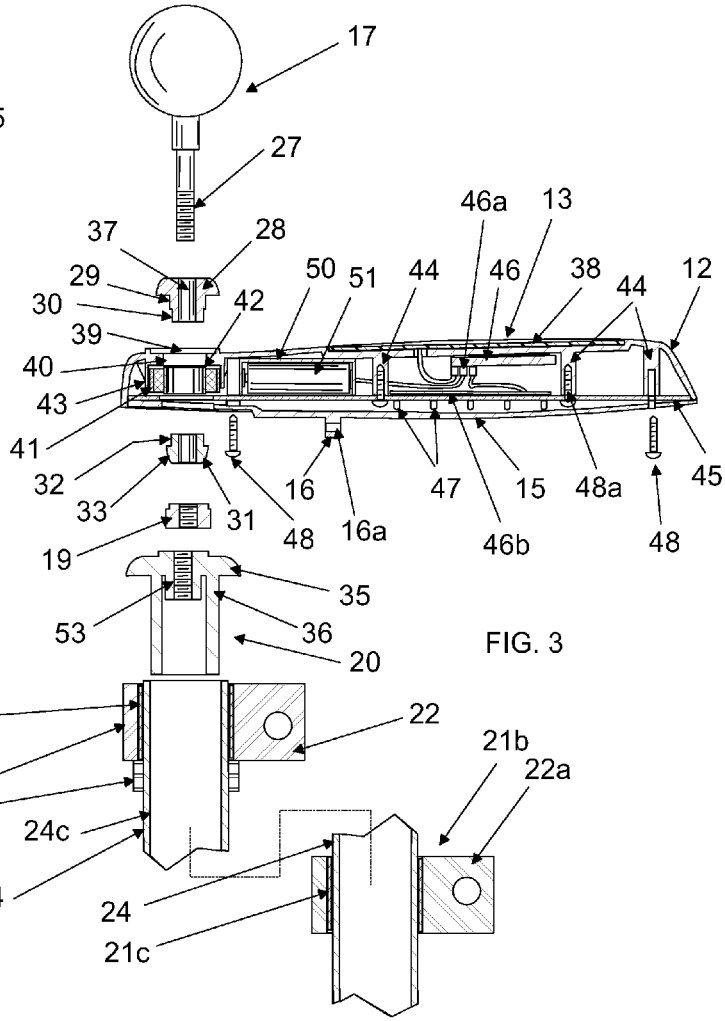
FIG. 3 is a cross section of items of FIG. 2 relating to the invention pole top light for flagpoles.

FIG. 3 shows side cross sections of top rotation fitting 18 (with smooth bore 37), housing 11, bottom rotation fitting 31 (with smooth bore for receiving bolt end 27), nut 19 (with a threaded bore), and adapter 20 (with threaded bore 53 for receiving bolt end 27 support the entire structure above adapter 20). Referring now to the cross section of housing 11, top surface 13 is seen to define an impression in which solar panel 38 is secured, preferably by gluing or other long lasting adhesive means. Housing 11 is preferably formed from aluminum or other corrosion and erosion resistant materials and forms a substantial downward facing cavity 11*a*, which is sealingly covered with a transparent cover 15 and comprises connector 16 with bore 16*a*.

Cover 15 further comprises openings for passage of screws 48 through aligned holes in a reflective shield 45, which is about the same size as cover 15, and allows screws 48 to be threaded into screw extensions 44, thereby securing cover 15 to shield 45, and both secured to the underside of housing 11. Cover 15 is curved downward from a flat reflective shield 45 (preferably comprising a thin metal sheet) to accommodate extension through shield 45 of 10 light emitting diodes 47 from circuit board 46*b* to a bottom side of shield 45 so that a mirrored and/or reflective underside of shield 45 causes lighted LED's 47 to provide the umbrella of light according to the objects of the invention.

An object of the invention is to provide for a rotatable poletop light having instantly replacable parts. The device of FIG. 3 provides for a microprocessor circuit board 46 to be glued or releasably attached to an inside ceiling of housing 11. Microprocessor 46 comprises a microprocessor and circuitry required for operation of the invention device, such that batteries 50 (preferably 3 metal hydride type batteries secured in battery pack 50, which is attached by screws to housing 11), LED's 47, and solar panel 38 all comprise removable plug connections 46*a* to circuit board 46, allowing for quick and inexpensive replacement of any of those components, including circuit boards 46 and 46*b*. The electrical components have been designed for separable replacement according to an optimization of cost and replacement times.

Referring now to axial end 14 of housing 11 of FIG. 3, a downwardly open cylindrical bearing holder 43 maintains therein a cylindrical bearing 41 by way of nut 19 threading to bolt end 27 to compress a lower edge of section 29 of top rotation fitting 18 onto a top edge of an inner race 42 while an upward facing edge of section 33 of bottom rotation fitting compresses upon a bottom edge of inner race 42, with sections 30 and 32 providing intervening support for bearing 41 from bolt end 27 as it passes through to engage nut 19 and adapter 20. A weather and water tight seal is formed when a lower surface of the decorative sphere 17 is impressed upon a top portion of section 28 of top rotation fitting 18 and a skirt underside of section 28 is impressed into a receiving cylindrical impression defined by rim 39 at the top surface of axial end 14. Opening 40 defined in the axial end 14 provides for passage of section 29 into said axial end 14.

Figure 5:
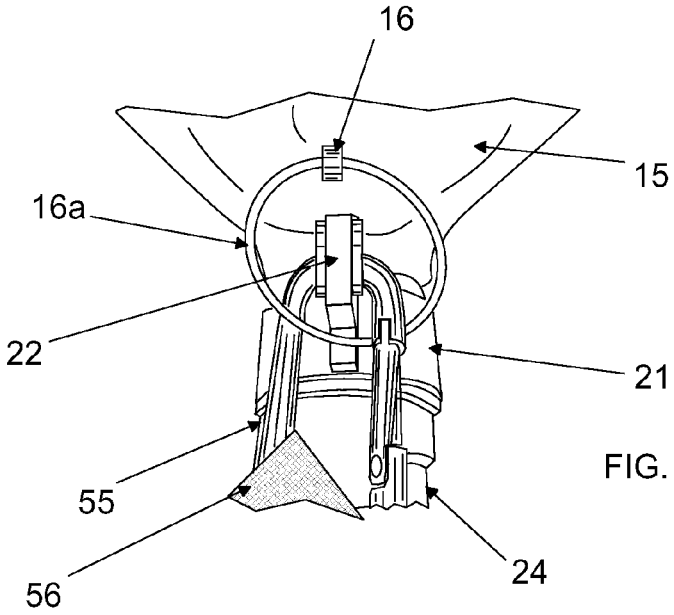
FIGS. 5 and 6 are bottom perspective views of broken away sections of the pole top light for flagpoles shown in FIG. 1 showing a rotation connection between a flag rotatably fixed to the flagpole and the pole top light for flagpoles shown in FIG. 1.
Figure 6:
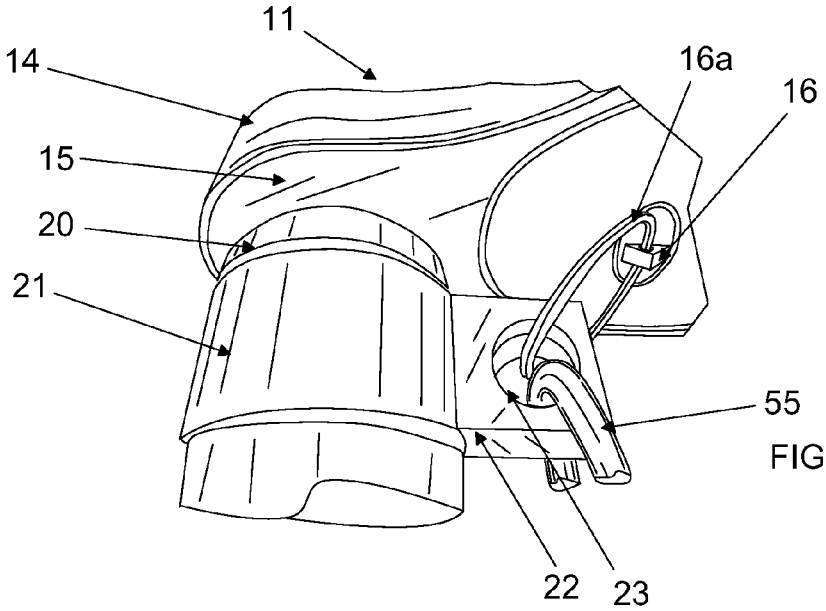

Referring again to FIG. 3, it will be appreciated that assembly of the components results in the device shown in FIG. 1, whereby, as shown in FIGS. 5 and 6, ring 16*a* connects connector 16 extending from cover 15 to flange 22 of rotatable band 21. Thus, the assembly of the decorative sphere and housing 11 and its integral components (including cover 15) are effectively made rotatable upon any rotation of rotatable band 21 via flag 56 (a top vertical corner being shown and being attached via carribeaner clip 55 to flange 22) being rotated about a vertical axis of flagpole 24, resulting in flag 56 being illuminated by lighting provided according to the objects of the invention.

Further describing adapter 20, a threaded bolt hole 53 is defined in flange skirt 35, which extends out from an upper periphery of cylindrical insert 36, which, upon insertion into an open top end of flagpole 24, engages its inside cylindrical walls 24*c*. A rotatable cap in the present specific example comprising the simple cylindrical band 24*a* fixed at just below a top of flagpole 24 which supports the rotatable band 21 (which may also include a plastic cylindrical sleeve 21*a* to reduce friction between an outside surface of flagpole 24 and an inside surface of rotatable band 21) from which laterally extends flange 22.

A broken away section shows an exemplary lower flag rotatable band 21*b* with sleeve 21*c* and lateral flange 22*a*, which is supported on flagpole 24 by way of attachment to a lower corner of an attached flag, providing rotational attachment for that lower corner in cooperating with rotatable band 21.

Referring again to FIG. 3, circuit board 46 comprises a microprocessor operating by way of a control program to provide for solar panel charging of batteries and turning LED's on and off. An input to the microprocessor is compared with a pre-set limit of ambient illumination LED's 47 turn on when ambient illumination is below a pre-set level, such as at nighttime, and turning LED's 47 off at times of high ambient illumination. Said input may comprise either of falling of solar panel charging below a pre-set level (indicating reduction in ambient light) or from input from an light sensor (not shown). Said microprocessor also provides means for charging batteries 51 via input from solar panel 13 and for powering LED's 47 from said batteries 51. Circuit board 46 is releasably attached to housing 11 for easy removal and replacement. Batteries 51 are also easily replaced, as is cover 15, shield 45, bearing 41, and solar panel 38. Failure of any component of the invention light requires only quick replacement of a low cost component, not the rest of housing 11 and its integral components and parts. The invention light is provided with means for inexpensive and quick replacement for any failed component.

Figure 4:
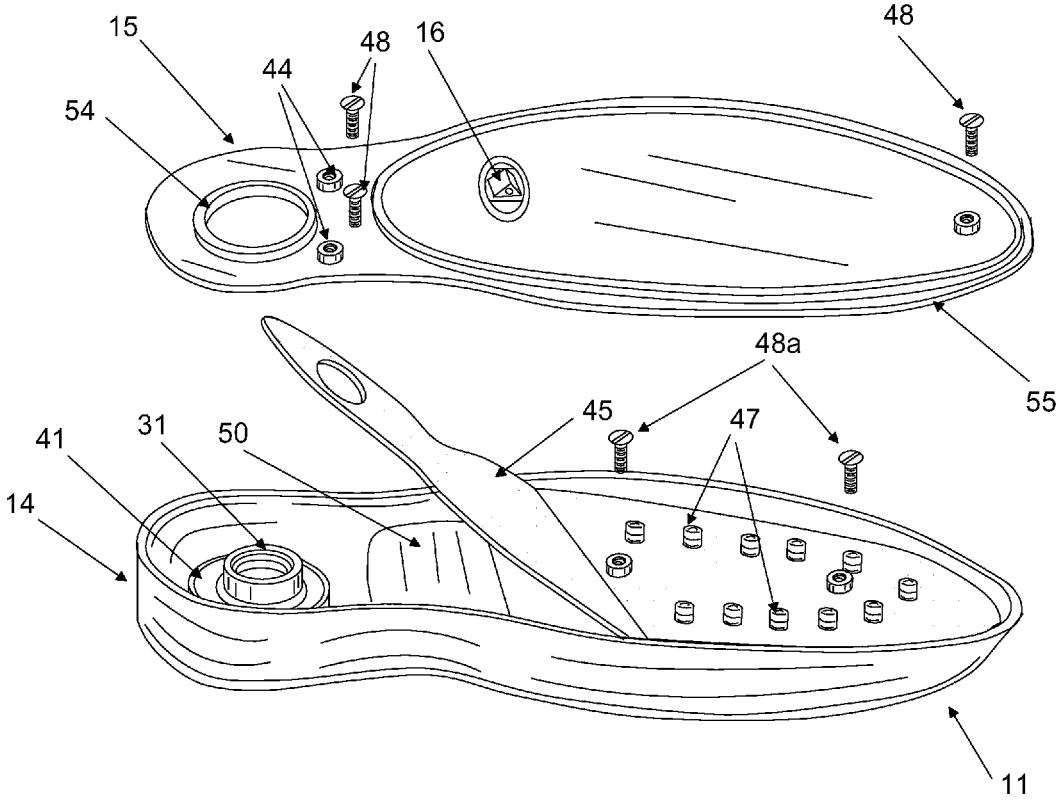
FIG. 4 is a bottom perspective view of the pole top light for flagpoles shown in FIG. 1 with a transparent bottom cover removed and showing portion of an interior of a cavity of a top housing with a part of reflective shield lifted up.

FIG. 4 shows housing 11 and cover 15 separated with screws 48 with drawn from their securing positions. LED's 47 are shown in a U-shaped pattern extending through reflective shield 45, which is raised to battery pack 50, bottom rotation fitting 31 and bearing 41 in axial end 14. A peripheral edge 55 seals to an inside surface of housing 11 when assembled, whereby opening 54 provides for passage of bottom rotation fitting therethrough for assembly as well. Screws 48*a* are provided to attach shield 45 to housing 11.

Figure 7:
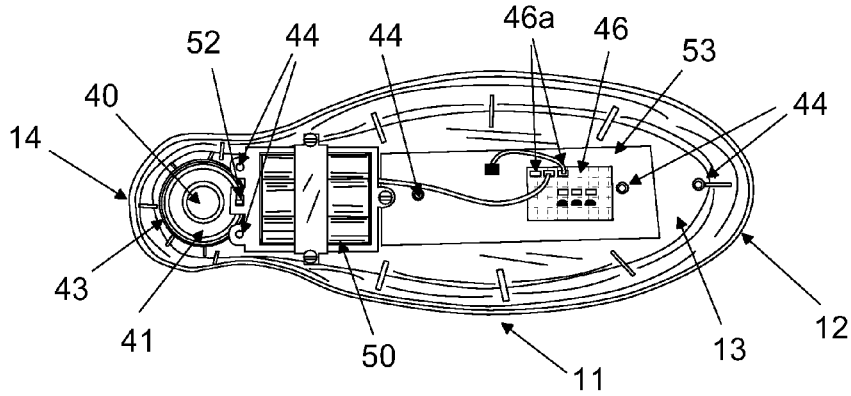
FIG. 7 is a bottom view of a housing of the pole top light for flagpoles shown in FIG. 1 with said transparent cover and reflective shield removed.
Figure 8:
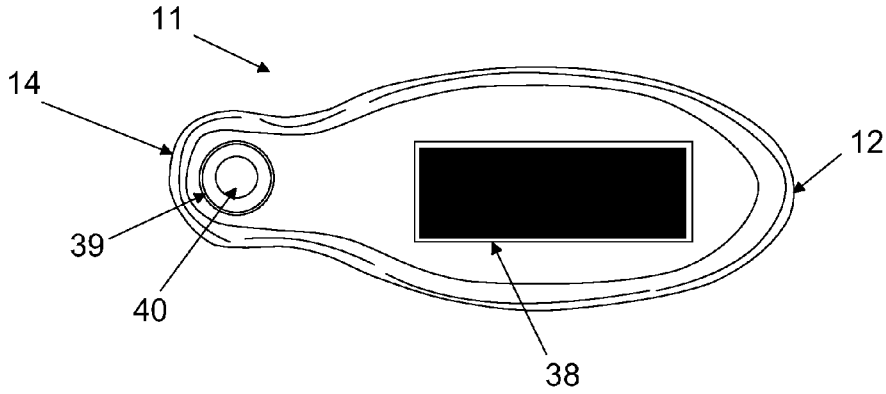
FIG. 8 is a top view of the pole top light for flagpoles shown in FIG. 1.

FIG. 7 shows housing 11 with its cover and shield removed, with a slight inward extension 53 to accommodate definition of a recess for solar panel 38 (as shown in FIG. 8). Battery pack 50 is adapted to provide an on-off switch 52 for turning electrical battery power on and off for the circuitry. Bearing holder 43 is shown as having an inner cylindrical diameter just larger than an outside diameter of bearing 41, allowing housing 11 and its other integral components to rotate about a flagpole axis either entirely upon a compressed inner race of bearing 41 or in combination with contact of housing 11 through holder 43 with the outer race of bearing 41. Such distribution of rotational forces extends the life of bearing 41, which is critical in a difficult to reach installation location as the top of a flagpole.

A further object of the invention is to provide a laterally extending and rotatable poletop light for flagpoles where a center of gravity of the light assembly is within about 4 inches of an axial rotation connection with the flagpole. Forming the housing of aluminum and locating the battery pack adjacent to a rotation bearing results in an unloading of force on said bearing, whereby the center of gravity of the entire assembly is close to the battery pack.

Preferred dimensions for the invention housing and integral cover attached are a lateral extending length of from 8 to 15 inches, and more preferably from 10 to 12 inches, a widest width at the lateral extension end 12 of from 3 to 6 inches, and more preferably from 4 to 5 inches, and a depth as described above.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A laterally extending pole top light assembly for a flagpole comprising:

(a) a rotatable cap means located at a top end of the flagpole for attachment of an upper corner of a flag and lower attachment means for a lower corner of said flag so that it may rotate about an axis of said flagpole when acted upon by wind;

(b) an adapter removably insertable into and located within a cylindrical top opening of the rotatable cap means and having a top section defining a vertical threaded bore wherein is secured a threaded bolt end of a vertical support shaft;

(c) a downwardly facing concave housing having an axial end with a narrower width than a lateral extension end, said axial end comprising rotation support means for rotational support of the housing from the support shaft adjacent to the top section of the adapter;

(d) a lighting means for illuminating the flag with lights supported within the lateral extension end of the housing and directed downward; and (e) a cap connecting means for connecting the housing with the rotatable cap so that the housing rotates when the flag causes the rotatable cap to rotate about the flagpole's axis.

2. The assembly of claim 1 wherein rotation support means comprises a cylindrical ball or roller bearing assembly oriented so that an inner bore is supported from the support shaft and an outer race is supported from a downward extension of an underside of the housing.

3. The assembly of claim 2 wherein a top rotation fitting is located compressed onto a top surface of an inner race of the bearing assembly.

4. The assembly of claim 3 wherein a bottom rotation fitting is located compressed onto a bottom surface of the inner race of the bearing assembly, whereby a substantial portion of the housing and its integral components are supported from said inner race of the bearing assembly.

5. The assembly of claim 4 wherein a bottom side of the bottom rotation fitting is supported in part upon a top surface of a threaded nut fixed upon the support shaft, whereby a bottom surface of that nut abuts the top section of the adapter.

6. The assembly of claim 5 wherein the top rotation fitting comprises an upper skirt sealingly seated to a top surface edge peripheral to an opening defined in the housing in the axial end through which passes a lower part of the top rotation fitting, which in turn comprises a bore within which the support shaft is engaged to the top rotation fitting.

7. The assembly of claim 6 wherein a decorative device is secured to a top end of the support shaft, a lower surface of said support shaft which sealingly engages a top surface of said skirt of the top rotation fitting to seal the housing from downward directed precipitation.

8. The assembly of claim 7 wherein a transparent cover is fixed to the underside of the housing to seal an opening defined by an outer peripheral edge of the housing and to protect the lighting means from weathering.

9. The assembly of claim 8 wherein lighting means comprises a circuit board located above and supporting the lights directed downward, whereby the lights are adapted to provide a substantially umbrella illumination pattern for the flag.

10. The assembly of claim 9 wherein the lighting means comprises a reflective shield underlying and supporting the circuit board and through which the lights pass so that their illumination is reflected from a reflective surface on the underside of the reflective shield.

11. The assembly of claim 10 wherein the lighting means comprises a solar panel secured to a top surface of the lateral extension end and connected to charge batteries secured within a battery pack which it turn in secured to an underside of the housing.

12. The assembly of claim 11 wherein the lighting means comprises an illumination sensor which detects ambient illumination, whereby its sensing of a pre-set low illumination level causes the lights to illuminate the flag.

13. The assembly of claim 12 wherein a wind powering means is fixed to extend outward from the housing so that wind flowing past the assembly causes generation of electrical power stored in a set of batteries within the housing.

14. The assembly of claim 13 wherein a set of screws removable from an external underside of the cover causes the cover, the bearing assembly, the reflective shield and the circuit board to be released from attachment to the housing so that these parts may be replaced.

* * * * *